US011235844B1

(12) United States Patent
Van Zanten

(10) Patent No.: US 11,235,844 B1
(45) Date of Patent: Feb. 1, 2022

(54) COLLAPSIBLE SURFBOARD CASE

(71) Applicant: Dan Van Zanten, San Marcos, CA (US)

(72) Inventor: Dan Van Zanten, San Marcos, CA (US)

( * ) Notice: Subject to any disclaimer, the term of this patent is extended or adjusted under 35 U.S.C. 154(b) by 0 days.

(21) Appl. No.: 17/372,376

(22) Filed: Jul. 9, 2021

(51) Int. Cl.
*B63B 32/80* (2020.01)
*B63B 32/87* (2020.01)
*A45C 7/00* (2006.01)

(52) U.S. Cl.
CPC ..... *B63B 32/87* (2020.02); *A45C 7/0031* (2013.01)

(58) Field of Classification Search
CPC ..... A45C 7/0031; B63B 32/80; B63B 32/87
See application file for complete search history.

(56) References Cited

U.S. PATENT DOCUMENTS

| | | | | |
|---|---|---|---|---|
| 5,470,956 | A | 11/1995 | Hayashi et al. | |
| 7,077,266 | B2 | 7/2006 | Dietrich | |
| 8,066,138 | B2 | 11/2011 | Boyles | |
| 8,381,930 | B2 | 2/2013 | Boyles | |
| 2004/0232016 | A1 | 11/2004 | Dietrich | |
| 2007/0183693 | A1 * | 8/2007 | Malloy | B63B 32/87 383/120 |
| 2018/0132584 | A1 * | 5/2018 | Boyles | A63C 11/026 |

FOREIGN PATENT DOCUMENTS

| | | | | |
|---|---|---|---|---|
| WO | WO-2017068369 A2 * | 4/2017 | | A45C 11/24 |

* cited by examiner

*Primary Examiner* — Andrew Polay
(74) *Attorney, Agent, or Firm* — Eversheds Sutherland (US) LLP; Nicola A. Pisano

(57) ABSTRACT

A collapsible protective case for surfboards having a rigid, impact-resistant outer surface, the case including a housing and a plurality of adjoining nested sections that are selectively configurable between a collapsed, fully nested position and an extended position, the housing and including a space configured to accommodate, in the extended position, fins disposed on a rear portion of the surfboard.

20 Claims, 3 Drawing Sheets

COLLAPSIBLE SURFBOARD CASE

FIELD OF THE INVENTION

The present invention relates generally to a collapsible hard case for protectively transporting a surfboard.

BACKGROUND OF THE INVENTION

Protective cases for surfboards, golf clubs and other sports equipment generally are known. By way of example, published U.S. Patent Application Publication No. 2004-0232016 and U.S. Pat. No. 7,077,266, both to Dietrich, describe telescoping hard cases for carrying golf bags, U.S. Pat. No. 5,470,956 to Peckenpaugh, Sr., describes a telescoping storage case for fishing poles or skis, and U.S. Pat. Nos. 8,066,138 and 8,381,930, both to Boyles, describe telescoping travel cases for surfboards.

Surfboards generally range in length from 6-10 feet, in width between about 2-3 feet, and in depth about 3 inches, and often are difficult to transport, even over relatively short distances.

Surfboards typically are stored in soft-sided bags or "socks" and generally are susceptible to damage, such as nicks and dents, while being transported from a surfer's home to the beach. Such minor cosmetic damage, and often much more severe damage, can be sustained to the surfboard during travel to remote destinations, e.g., especially when shipping a surfboard through via commercial aviation. In many cases, incidental damage to a surfboard during travel and/or transportation makes a surfboard much less aesthetically pleasing, an important consideration, as high-end surfboards can cost upwards of several thousands of dollars.

One previously-known commercially available rigid surfboard case, offered by Santa Monica Hard Case in California, USA, is formed of a flexible plastic that leaves the boards vulnerable to damage during transport or shipment. Also, that product is offered with limited size options and features, and cannot be transitioned to a reduced size when not in use.

A coating of surfer's wax typically is applied to the upper surface of a surfboard to improve the surfer's footing on the board when in use. When the surfboard is later inserted into a conventional soft-sided surfboard case, the wax can stick to the interior surface of the case, enhancing the difficulty in inserting the surfboard into, and later removing the surfboard from, the soft-sided case. In addition, such cases provided very little protection to the fins that extend from the rear surface of the surfboard, often leading to bending or other accidental damage to the surfboard fins.

In view of the foregoing, there is a need for a protective case for surfboards that also provides for convenient storage when not in use, and that accommodates and protects the surfboard fins against damage during transport.

SUMMARY OF THE INVENTION

In accordance with the principles of the present invention, a protective case for surfboards is provided that enhances ease with which the surfboard can be inserted and removed from the case, and further, that accommodates and protects the fins on the rear surface of the surfboard. Further in accordance with the present invention, the case includes a housing and a plurality of nested sections configured to transition between an extended mode suitable for completely covering a surfboard, and a collapsed for storage mode when not in use, wherein the plurality of nested sections are fully nested within the housing. Preferably, the nested sections that cover the forward portion of a surfboard in the extended mode are sequentially tapered to generally approximate the contour of the forward portion of most surfboards.

At least the housing of the collapsible protective surfboard case is constructed of a rigid, impact-resistant material, such as a multilayer polycarbonate material. The plurality of nested sections preferably also is constructed of rigid impact-resistant material, or alternatively may comprise wire frames covered by a light, flexible material, such as ballistic nylon.

Preferably, the housing includes front and rear caps that may be removably detached from the housing, when the case is not in use, to retain the plurality of nested sections fully within the housing. The end caps may include one or more latches for engaging the end caps to the housing. The housing also may include a handle disposed on its exterior surface for conveniently carrying the case, when in the collapsed mode.

In accordance with another aspect of the present invention, an outermost section, disposed between the housing and an adjoining one of the plurality of nested sections includes a ramp along a frontal portion that defines a reduced opening, through which the adjoining one of the plurality of nested sections extends in the extended mode. Preferably, the housing together with the outermost section provided a volume sufficient to accommodate fins disposed on the rear portion of a surfboard, to protect the fins from damage during transport. One or more form removable blocks may be provided to cushion the fins when a surfboard is disposed within the case.

These and other aspects of the present invention will become apparent to those skilled in the art after a reading of the following description of the preferred embodiment when considered with the drawings, as they support the claimed invention.

DETAILED DESCRIPTION OF THE INVENTION

Referring now to FIGS. 1A to 1C and 2A to 2C, an exemplary embodiment of the present invention is described. The present invention provides a protective case for surfboards, which is configured to be used in a fully deployed mode for completely protectively containing a surfboard, and to be alternatively collapsed to a storage mode when not in use, i.e., when the surfboard is not stored therewithin. More particularly, the present invention includes a collapsible protective case for surfboards with a housing constructed of an impact-resistant material outer surface, such as multilayer polycarbonate, which is both lightweight and rigid, especially when the plurality of adjoining sections are transitioned to an expanded transport configuration.

Preferably, the rigid, impact-resistance outer surface is formed from a hard plastic or composite material that is sufficiently thick to prevent puncture or tearing, resist pressure, flexing or deformation, such that the surfboard contained completely within the housing is protected from any external forces.

Figure 1A:
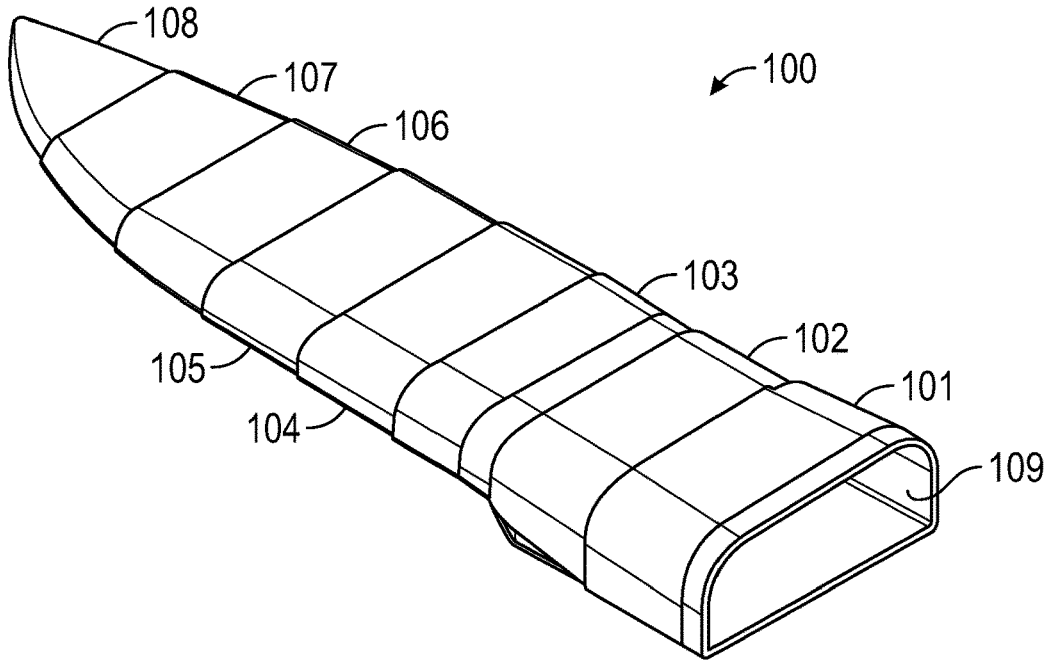
FIGS. 1A, 1B and IC are, respectively, a rear perspective view, plan view and elevation view of a surfboard case in an extended mode according to one embodiment of the present invention.
Figure 1B:
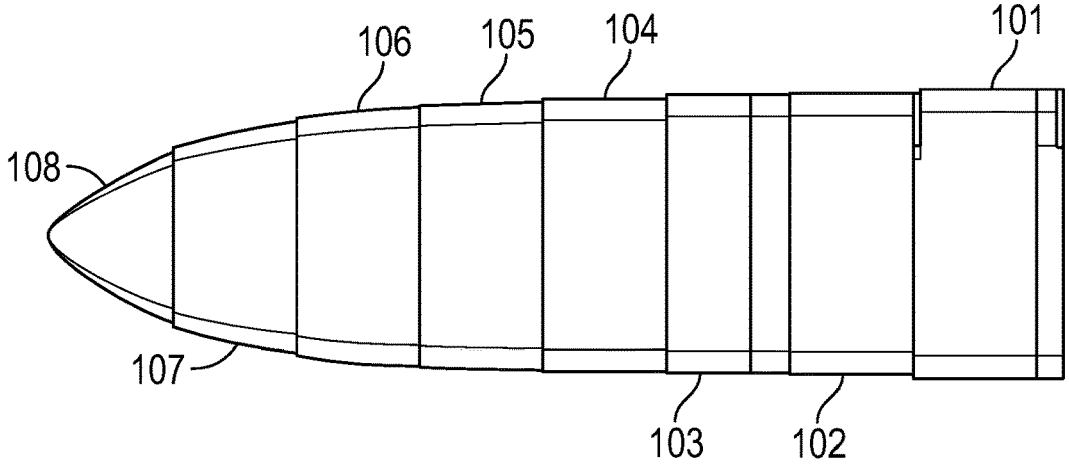
Figure 1C:
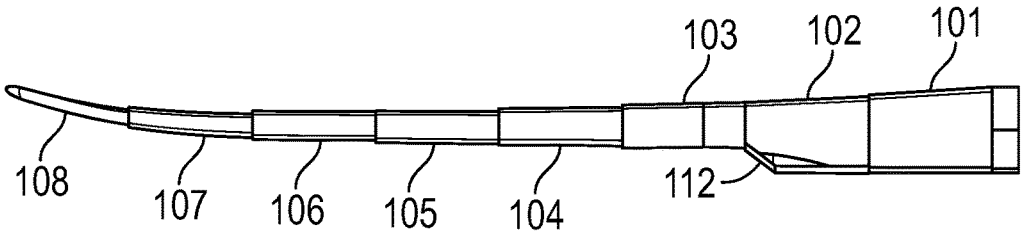
Figure 2A:
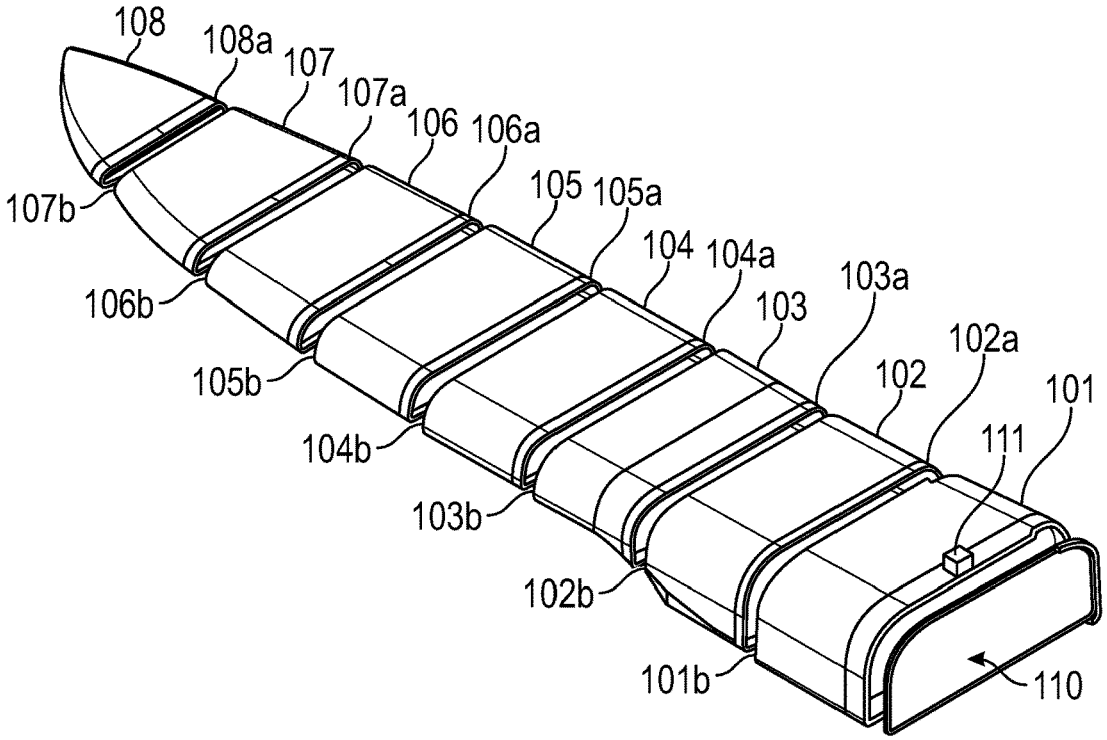
FIGS. 2A, 2B and 2C are, respectively, exploded rear perspective view, exploded plan view and exploded elevation view of the surfboard case of FIG. 1.
Figure 2B:
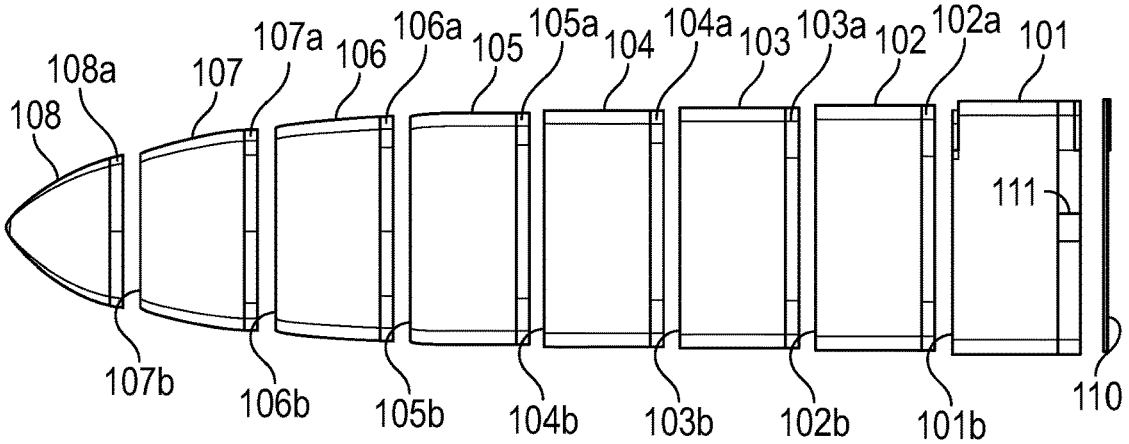
Figure 2C:
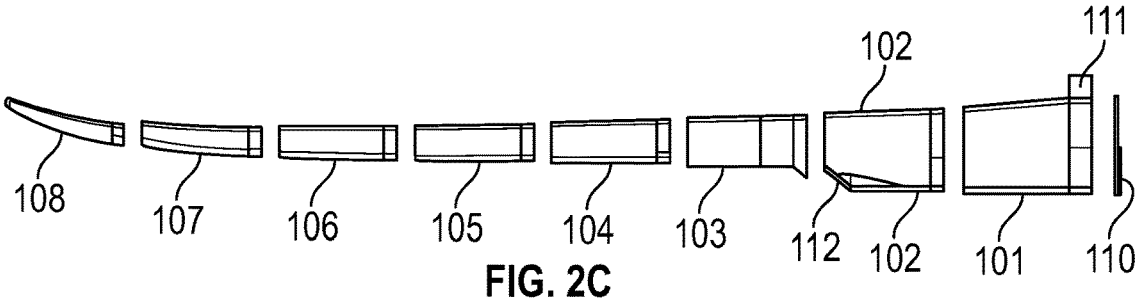

Referring to FIGS. 1A-1C, case 100 comprises housing 101 and illustratively includes plurality of sections 102, 103, 104, 105, 106, 106 and 108 configured to nest within adjoining sections. Section 102, the outermost section, is configured to nest fully within housing 101. As will be generally understood for telescoping sections, the sections include features that interengage with adjoining proximal and distal sections when case 100 is in the extended configuration. More specifically, referring to FIGS. 2A to 2C, each of sections 102-108 has an enlarged feature, e.g., 102*a*, 103*a*, 104*a*, 105*a*, 106*a*, 107*a*, 108*a*, at its proximal edge that engages a corresponding lip, e.g., 101*b*, 102*b*, 103*b*, 104*b*, 105*b*, 106*b*, and 107*b* disposed on the distal edge of the proximal adjoining section, such that the enlarged features interengage the lips of the proximal adjoining section when the case is in its extended configuration. In an alternative embodiment, and as will be apparent to one of skill in the art of telescopic designs, the enlarged features and lips may be transposed between housing 101 and adjoining sections 102-107.

Section 108 has no lip at its distal edge because the innermost nesting section 108 forms a closed nose cone. As also depicted in FIG. 1A and FIGS. 2A to 2C, the top, bottom, and sidewalls of housing 101 form rear opening 109 through which a surfboard may be inserted into case 100 when in the extended configuration. Rear end cap 110 may be removably fastened to the proximal end of housing 101 to cover rear opening 109 using latching mechanism 111, e.g., buckle, hook and pile strap, etc.

In accordance with one aspect of the invention, distal portion of outermost section 102 includes upward ramping front wall 112 along its distal edge, which defines a reduced frontal opening area in outermost section 102 through which adjoining section 103 extends when the case is in its extended configuration. Upward ramping wall 112 creates sufficient volume within outermost section 102 so that, together with the volume within housing 101, outermost section 102 and housing 101 can accommodate fins extending from the underside of the rear portion of a surfboard to fully enclose and protect the fins during transport.

As illustrated in the figures, at least sections 105, 106, 107 and 108, which cover a forward portion of the surfboard, may be laterally and vertically tapered to approximate the contours of popular surfboard shapes.

Figure 3A:
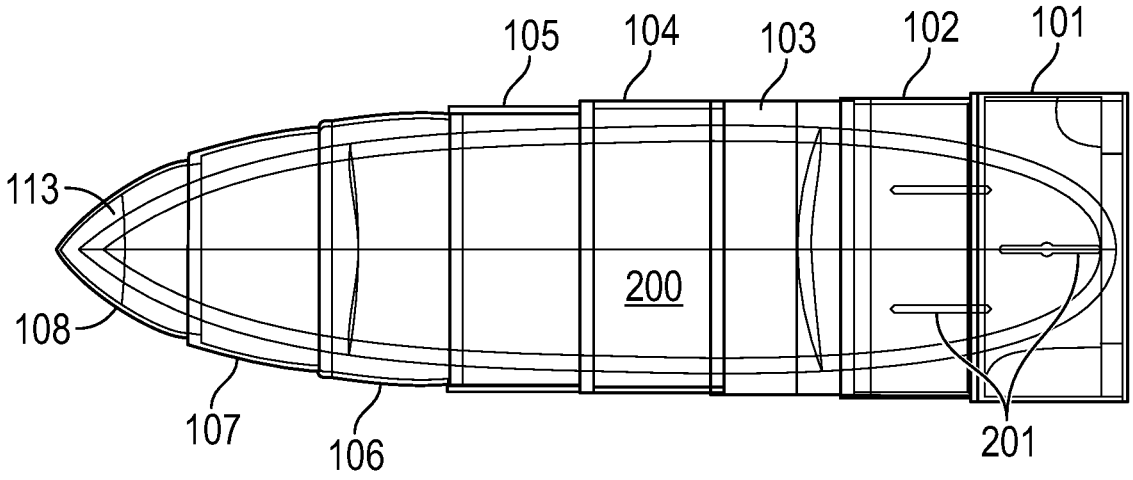
FIGS. 3A and 3B are, respectively, a plan view and side elevation view showing a conventional surfboard disposed with then surfboard case of FIGS. 1 and 2.
Figure 3B:
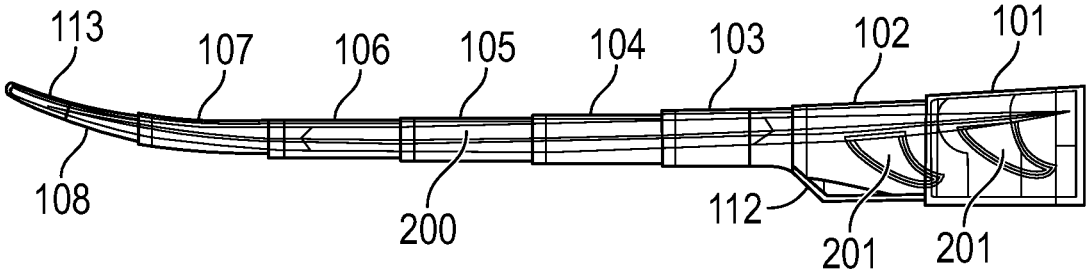

Referring now to FIGS. 3A and 3B, housing 101 and plurality of nested sections 102-108 of case 100 are shown as wireframe outlines in the extended configuration with an exemplary surfboard 200 disposed within case 100. As described above, distal sections of the case, e.g., sections 105 to 108 approximately conform to the lateral and vertical shape of surfboard 200 to prevent the surfboard from sideways or vertical movement within the case, while the space created by outermost section 102 and housing 101 provides sufficient height to accommodate the fins 201 of the surfboard without crushing or bending. Additionally, foam block 113 may be provided in within section 108 to engage the forward end of surfboard 200 to prevent damage to the nose of the surfboard. Removable foam blocks (not shown) may be inserted between the rear underside of surfboard 200 and the bottom surface of housing 101 to cushion fins 201. Additional removable foam blocks (not shown) may be inserted between the rear topside of surfboard 200 and the top wall of housing 101 to prevent vertical movement of the rear portion of the surfboard during transport.

Figure 4:
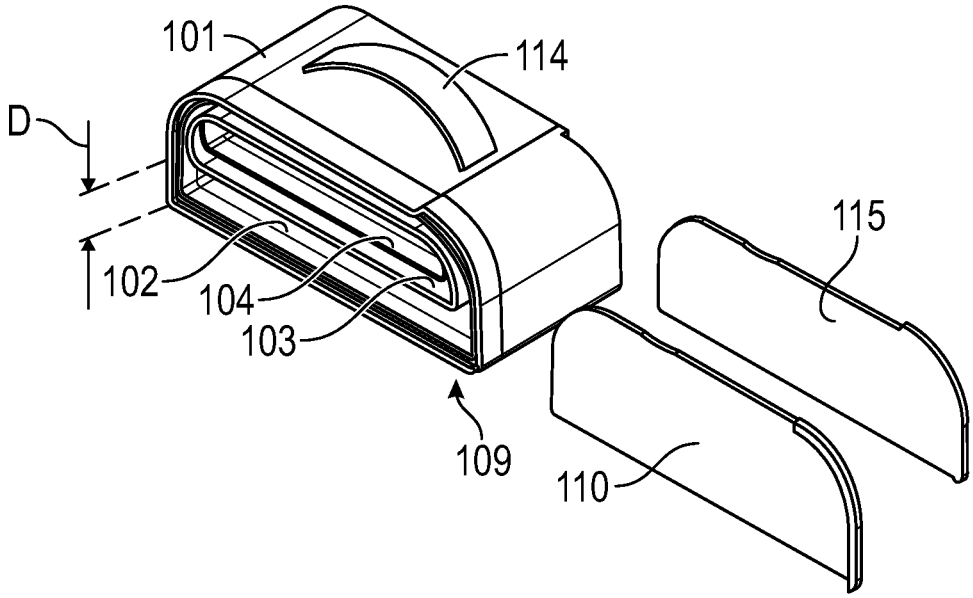
FIG. 4 is a perspective rear view of the surfboard case of FIGS. 1 and 2, in the collapsed mode, with the front and rear end caps displaced laterally.

Referring now to FIG. 4, case 100 is described in a collapsed configuration. In the collapsed configuration, each of sections 102 to 108 fully nests within the proximal adjoining section, i.e., section 108 nests within section 107, section 107 nests within section 106, section 106 nests within section 105, section 105 nests within section 104, section 104 nests within section 103, section 103 nests within section 102, and section 102 nests within housing 101. As shown in FIG. 4, upwardly ramped wall 112 of section 102 causes section 103 to nest at a position spaced apart from the bottom wall of section 102 by a distance D, which spacing provides the additional volume in section 102 and housing 101 to accommodate surfboard fins 201 when the case is transitioned to the extended configuration. Also shown in FIG. 4 is optional handle 114, which may be coupled to housing 101 to facilitate carrying of the case when not in use, i.e., in the collapsed configuration.

Still referring to FIG. 4, rear cap 110 and front cap 115 are described. As discussed above, rear cap 110 may be fastened to over rear opening 109 to fully enclose a surfboard when the case is in the extended configuration to retain the surfboard within the case. Rear end cap 110 may be fastened over rear opening 109 and front cap 115 also may be fastened to front of housing 101 to retain nested sections 102-108 within the housing when it is not in use.

Optionally, a detachable carrying strap may be fastened to the exterior of case 100, using suitable fasteners, not shown, when case 100 is in the extended configuration to facilitate carrying of the case when in use. Preferably, housing 101 has a depth from front to rear of about 12 inches, a height from top to bottom of about 9 inches, and a width from side to side of about 24 inches.

Certain modifications and improvements will occur to those skilled in the art upon reading the foregoing description. For example, the depth of housing 101 may be increased, e.g., from 12 inches to 18 inches or more, so that the housing provides the volume necessary to accommodate the surfboard fins. In this case, ramp 112 of outermost section 102 may be incorporated directly into the forward wall of the housing 101, and proximal 102*a* and distal edge 102*b* of outermost section 102 are configured similarly to that of the other sections. The above mentioned examples are provided to serve the purpose of clarifying the aspects of the invention and it will be apparent to one skilled in the art that they do not serve to limit the scope of the invention.

What is claimed is:

1. A protective case for a surfboard comprising:

a housing having a top wall, a bottom wall, and first and second sidewalls joining the top wall to the bottom wall, the top, bottom and first and second sidewalls defining a rear opening and a front opening;

an outermost section slidably disposed within the housing to transition between a collapsed configuration, wherein the outermost section is fully nested within the housing, and an extended configuration, wherein the outermost section extends through the front opening, the outermost section having a front wall that extends upwards to define a reduced area frontal opening; and a plurality of nested sections slidably arranged within the outermost section to transition from a collapsed configuration, wherein the plurality nested sections fully nest within the outermost section, to an extended configuration, wherein the plurality of nested sections extend longitudinally through the reduced area frontal opening and interengage to define an elongated volume sufficient to accommodate all but a rear portion of a surfboard when the surfboard is inserted through the rear opening;

wherein the front wall of the outermost section defines a space within the outermost section and the housing, when the outermost section and plurality of nested sections each are in the extended configuration, sufficient to accommodate fins disposed on the rear portion of the surfboard.

2. The protective case of claim 1, wherein at least some of the plurality of nested sections are tapered.

3. The protective case of claim 1, further comprising a rear cap configured to be removably coupled to the housing to cover the rear opening.

4. The protective case of claim 1, further comprising at least one latch configured to removably couple the rear cap to the housing.

5. The protective case of claim 1, further comprising a front cap configured to retain the outermost section and the plurality of nested sections within the housing when the case is in the collapsed configuration.

6. The protective case of claim 1, further comprising a carrying handle coupled to the housing.

7. The protective case of claim 1, wherein the housing comprises an impact-resistant material.

8. The protective case of claim 7, wherein each of the outermost section and the plurality of nested sections comprises an impact-resistant material.

9. The protective case of claim 8, impact-resistant material comprises a multilayer polycarbonate material.

10. The protective case of claim 1, further comprising at least one foam block disposed in the housing to cushion a surfboard when inserted into the case when the case is in the extended configuration.

11. A protective case for a surfboard comprising:

a housing having a top wall, a bottom wall, and first and second sidewalls joining the top wall to the bottom wall, the top, bottom and first and second sidewalls defining a rear opening and a front opening, the housing having a depth of about 12 inches between the front opening and the rear opening;

an outermost section slidably disposed within the housing to transition between a collapsed configuration, wherein the outermost section is fully nested within the housing, and an extended configuration, wherein the outermost section extends through the front opening, the outermost section having a front wall that extends upwards to define a reduced area frontal opening; and a plurality of nested sections slidably arranged to transition from a collapsed configuration, wherein the plurality nested sections are fully nested within the outermost section, to an extended configuration, wherein the plurality of nested sections extend longitudinally from the outermost section and interengage to define an elongated volume sufficient to accommodate a front portion of a surfboard when the surfboard is inserted through the rear opening;

wherein the front wall defines a space within the outermost section and the housing, when each of the outermost section and the plurality of nested sections are in the extended configuration, sufficient to accommodate fins disposed on a rear portion of the surfboard.

12. The protective case of claim 11, wherein at least some of the plurality of nested sections are tapered.

13. The protective case of claim 11, further comprising a rear cap configured to be removably coupled to the housing to cover the rear opening.

14. The protective case of claim 11, further comprising at least one latch configured to removably couple the rear cap to the housing.

15. The protective case of claim 11, further comprising a front cap configured to retain the outermost section and the plurality of nested sections within the housing when the case is in the collapsed configuration.

16. The protective case of claim 11, further comprising a carrying handle coupled to the housing.

17. The protective case of claim 11, wherein the housing comprises an impact-resistant material.

18. The protective case of claim 17, wherein each of the outermost section and the plurality of nested sections comprises an impact-resistant material.

19. The protective case of claim 18, impact-resistant material comprises a multilayer polycarbonate material.

20. The protective case of claim 11, further comprising at least one foam block disposed in the housing to cushion a surfboard when inserted into the case when the case is in the extended configuration.

* * * * *